United States Patent [19]

Brotz

[11] Patent Number: 5,042,479

[45] Date of Patent: Aug. 27, 1991

[54] THERAPEUTIC VIBRATORY BATH

[76] Inventor: Gregory R. Brotz, P. O. Box 1322, Sheboygan, Wis. 53081

[21] Appl. No.: 398,409

[22] Filed: Aug. 25, 1989

Related U.S. Application Data

[63] Continuation-in-part of Ser. No. 162,132, Feb. 29, 1988.

[51] Int. Cl.[5] ..... A61H 33/00

[52] U.S. Cl. ..... 128/365; 4/491; 4/494; 128/34 A; 128/66

[58] Field of Search ..... 128/24 AA, 33, 365, 128/368-370, 374, 660.01, 66; 4/494, 542, 527, 528, 491

[56] References Cited

U.S. PATENT DOCUMENTS

| | | | |
|---|---|---|---|
| 681,631 | 8/1901 | Durrin | 4/527 |
| 720,357 | 2/1903 | Joachimson | 128/395 |
| 3,361,895 | 1/1968 | Achner | 128/374 |
| 3,499,436 | 3/1970 | Balamuth | 128/24 AA |
| 3,499,437 | 3/1970 | Balamuth | 128/24 AA |
| 3,585,991 | 6/1971 | Balamuth | 128/24 AA |
| 3,920,011 | 11/1975 | Losee | 128/24 AA |
| 3,943,580 | 3/1976 | Carter | 4/542 |
| 4,622,972 | 11/1986 | Giebeler Jr. | 128/24 AA |

FOREIGN PATENT DOCUMENTS

| | | | |
|---|---|---|---|
| 3713816 | 11/1987 | Fed. Rep. of Germany | 128/365 |

*Primary Examiner*—Edward M. Coven
*Assistant Examiner*—Mark S. Graham
*Attorney, Agent, or Firm*—William Nitkin

[57] ABSTRACT

A therapeutic vibratory bath with a containment chamber for receipt of fluid medium and the individual to be bathed, such chamber having in one embodiment a plurality of vibration-producing devices arrayed around the chamber, such arrays disposed at a plurality of levels, the operation of which vibrators is performed in a sequence to produce a desired vibrational pattern in the medium around the individual being bathed.

8 Claims, 10 Drawing Sheets

THERAPEUTIC VIBRATORY BATH

This application is a continuation-in-part of my previously filed application Ser. No. 162,132 filed Feb. 29, 1988 of the same title, now pending.

BACKGROUND OF THE INVENTION

1. Field of the Invention

The device of this invention relates to therapeutic baths for individuals and more particularly relates to a bath with a medium-holding containment chamber in which individuals are positioned and around which chamber a plurality of vibration means are arrayed.

2. Description of the Prior Art

Baths especially designed for treatment of ailments are well known with whirlpool baths being a prime example of such baths. Other types of therapeutic baths such as bubbling baths, heated baths and mineral baths are also known in the prior art. It has been long known that people with skin diseases, burns, or muscular ailments will benefit from various therapeutic bathing techniques. For example whirlpool baths apply pressure to muscles of the body by the various movements of the water.

SUMMARY OF THE INVENTION

It is an object of this invention to provide a therapeutic bath for the treatment of burns, hypertension, circulatory disturbances, rheumatic and arthritic conditions, various metabolic diseases and nervous conditions incorporating various bathing mediums and vibration patterns.

It is a further object of this invention to provide a therapeutic bath which is utilizable by individuals, even by those suffering from debilitating or degenerative muscular disease and which can provide passive muscle exercise and muscle massage to the user.

The basic structure of the bath of this invention allows for a patient to be placed in a fluid medium wherein a vibration pressure wave pattern is set up within the medium around the patient such pattern selected from a variety of wave patterns as will be described below which movement of the medium against the patient will help to treat the specific ailment of the patient.

The basic structure of this invention provides for a containment chamber which can be formed of resilient material such as rubber or in alternative embodiments, of rigid material as will be described below. This chamber is formed with an area defined therein for the holding of a fluid medium and also to receive the individual being treated in the bath. The chamber can be generally cylindrical in shape, but other shapes will fall within the scope of this invention. Around the chamber is disposed a plurality of vibratory devices attached in multilevel parallel arrays, each array positioned at a different height within the containment chamber and each vibratory member designed to operate at a selected frequency and in a selected sequence with one another to provide vibrating motion tailored to the specific needs of the patient. For example, a pressure wave pattern can be structured in a spiraling downward pattern depending upon the sequencing of the vibrators or, for example, a pattern can be produced where all of the vibrators at a particular vertical level operate in unison to create a harmonic pressure wave between the levels of vibrators. In another example, vibrators located at two diametrically opposing positions around the containment chamber can operate in unison and the vibrator operation could be in a rotational sequence around the major axis of the cylindrical containment chamber to create a spiraling pattern of the fluid medium around the body. There also could be a completely random sequencing of vibrators. The pattern of vibrator operation will be determined by the desired result to be achieved. Some desired results will call for a wave pattern which runs from the top of the body to the bottom to remove debris and cause such debris to settle to the bottom of the containment chamber while other patterns can be utilized for muscular toning wherein one might want patterns to push against muscles at particular levels within the containment chamber.

The containment chamber can, in one embodiment, be made of a rubber-like material that is resilient, but the material of the chamber's construction depends upon the level and frequency of vibrations desired to be employed in the device. For example, if the vibrations are to be in the ultrasonic range, the container can be composed of a more rigid material.

The fluid medium that is placed in the container can vary depending on the type of therapy desired. In the treatment of muscular conditions, warm water can be used if the patient to be treated has bedsores complicated by an atrophy of muscles, an oil with an antibacterial agent can be used. Certain salt solution mediums also can be of benefit to certain patients. Other mediums such as fluorine compounds which will oxygenate the skin can also be used.

For burn patients, the use of the device of this invention can provide optimum means to dislodge dead skin, foreign matter, fabric and debris from the affected area. Fluorine compounds that are known to transport available oxygen could be used in the medium not only to help dislodge debris but also to supply oxygen to burned skin areas that might otherwise die from lack of oxygen due to circulation restrictions resulting from histamine productions or from other types of trauma such as chemical contamination.

The medium in some cases can be purified by filtration means, heating or pasteurization steps and recirculated for reuse. Any heat decomposable agents can be recrystallized out of solution and then put back into solution in fresh solvents with the solvent being purified by a distillation process.

It is anticipated that patients, when able to, will enter the bath of this invention by their own power. However, where a patient is physically unable to enter the bath of this invention, such individual can be placed in the bath by means of lifts and harnesses. Once in the device such patient can be safely maintained in proper position by collars and harnesses to prevent his head from going below the surface of the bath medium.

BRIEF DESCRIPTION OF THE DRAWINGS

FIG. 6 illustrates an alternate containment chamber construction suitable for an individual to sit in.

DESCRIPTION OF THE PREFERRED EMBODIMENT(S)

Figure 1:
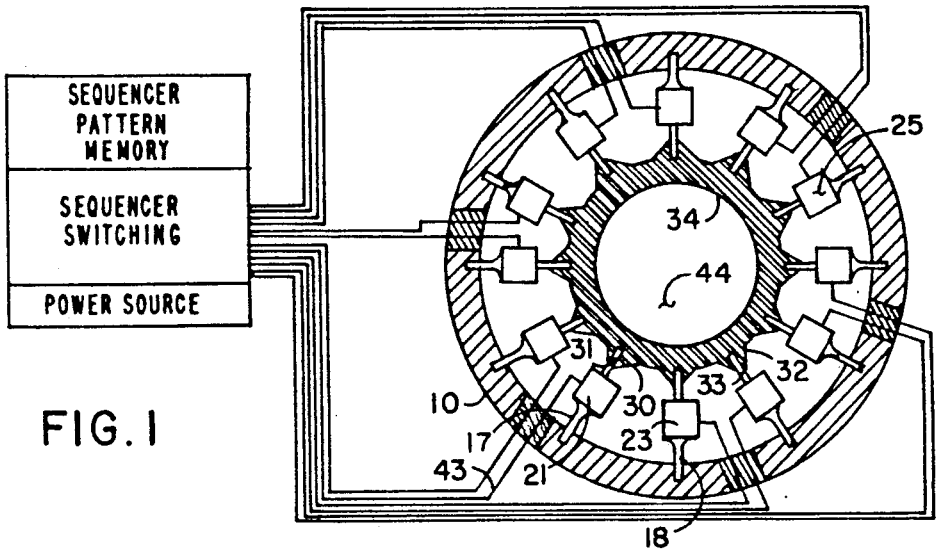
FIG. 1 illustrates a top view of the containment chamber of this invention held within a casing with an array of vibrators affixed therearound.

FIG. 1 illustrates a top view of the device of this invention showing the containment chamber 34 in the center of which is the user positioning area 44. Containment chamber 34 has portions such as 30 and 32 which extend to and around to attach to the ends of arms 31 and 33 extending from particular vibrators such as vibrators 21 and 23 which vibrators are attached to the outer casing 10 by rear attachment members 17 and 19. All the other vibrators in the multi-level arrays are held similarly. In this fashion the rear attachment members hold the vibrating devices in position and the arms such as arm 31 are then attached such as by having a portion of containment chamber 34 formed around the end of such arm so that when vibrator 21, for example, operates, arm 31 moves the resilient containment chamber 34 in a fashion to impart such vibration into medium 42 held therein. Each vibrator in circular array 25 around containment chamber 34 will vibrate in a sequence as determined by provision of electrical current thereto to turn each individual vibrator on or off. Such vibrating motors are well known in the art and many types of such vibrators could be utilized and incorporated into the structure of this invention such as, but not limited to, electrically driven mechanical vibrators, pneumatically driven vibrators, acoustical vibrators and ultrasonic vibrators. The sequencer pattern memory 38 can be of a programmable computer-type or stored on a chip which will contain a selection of pattern memories so that the operator can choose the sequence of activations of the vibrators. Such choice would then be directed to a sequencer switching unit 40 which would then direct the power source 42 along the particular wires such as wire 43 extending to vibrator 21 whereby when the sequencer pattern memory determined that a particular vibrator is to operate, the sequencer switching control 40 would direct the current from power source 42 the current so that it would turn such vibrator on and would then also turn it off upon the cessation of current thereto. Such electrical control mechanisms are well known to those skilled in the art of controlling the sequence of operation of devices. The positioning of the circular arrays, such as circular array 25 as seen in FIG. 1, of vibrators at particular height levels such as at first level 14, as seen in FIG. 2, and at levels designated by 16, 18, 20, 22 and 24 allows for the device to produce a variety of vibrational patterns within medium 42 held in containment chamber 34.

Figure 2:
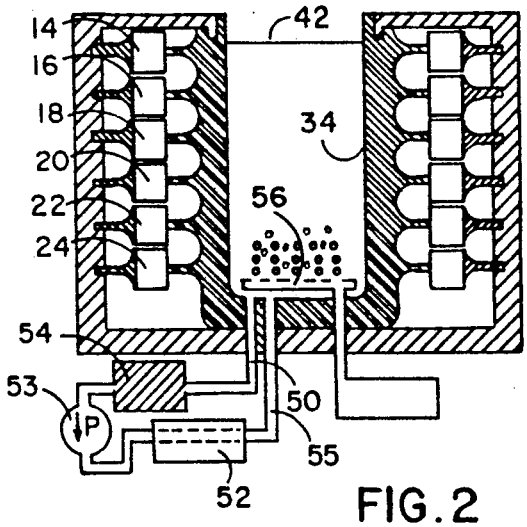
FIG. 2 illustrates a cross-sectional view through a side of the device of this invention showing the containment chamber with a plurality of levels of vibrators arrayed therearound.

In some embodiments, the apparatus can have drain member 50 seen; in FIG. 2 positioned at its bottom for medium circulation or for passing the medium through a heating means such as heating pipe 52 to maintain or change the temperature of the medium within the bath and direct it back into the containment chamber. The drain can also have filtering means 54 to remove debris from the medium depending upon the type of use of the vibrating bath. The base of the apparatus can also be equipped with bubble plate 56 or other means to supply bubbles such as compressed gas so that this type of aeration and medium agitation can be available to the health professional. When the device of this invention contains fluorine compounds, it is desirable that such device use such compounds with a pump 53 and recirculation means such as pipe 55 so as to clean and purify the fluid so that it is possible to decontaminate such fluids as they are used.

Figure 3:
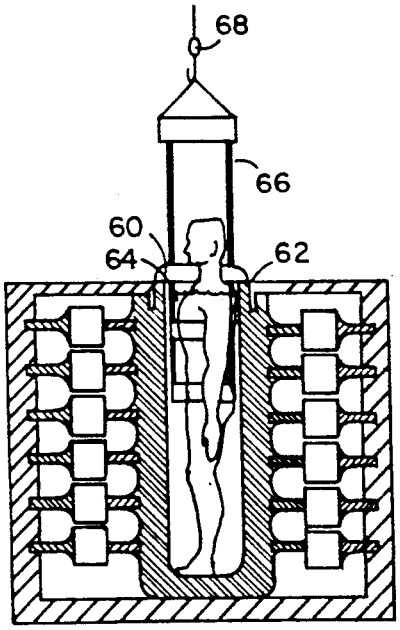
FIG. 3 illustrates a view of a containment chamber showing an individual held in place by a harness with a collar holding the individual's head out of the medium.
Figure 4:
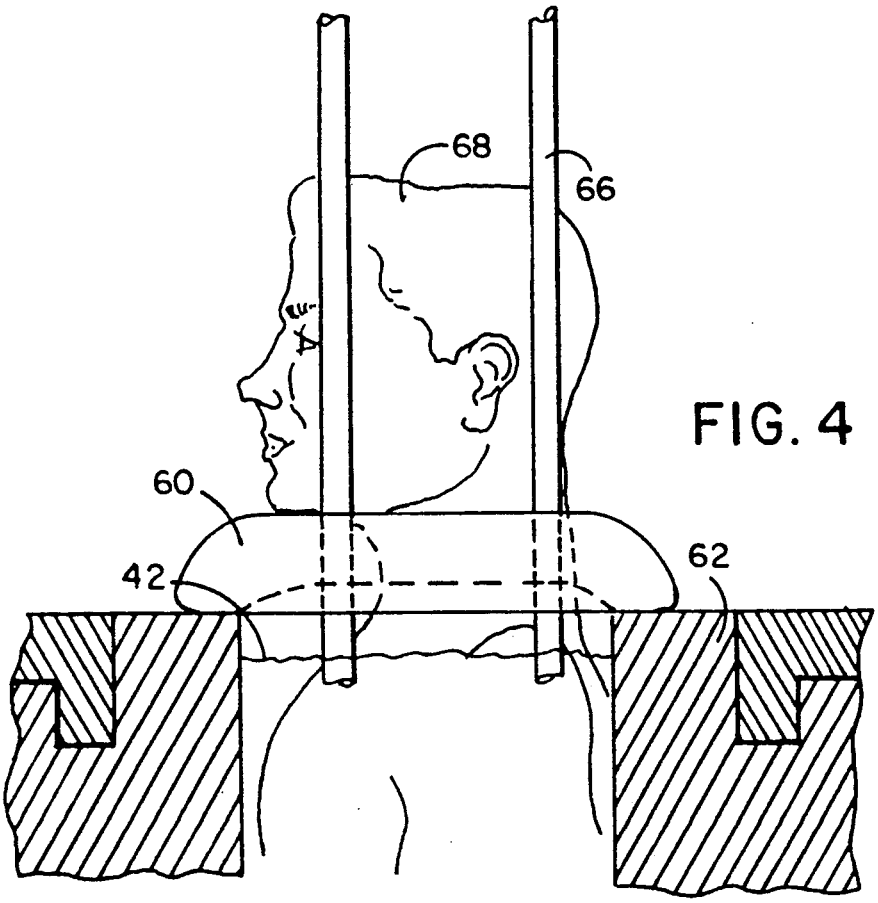
FIG. 4 illustrates an enlarged view of the collar in use holding the individual's head out of the medium.
Figure 5:
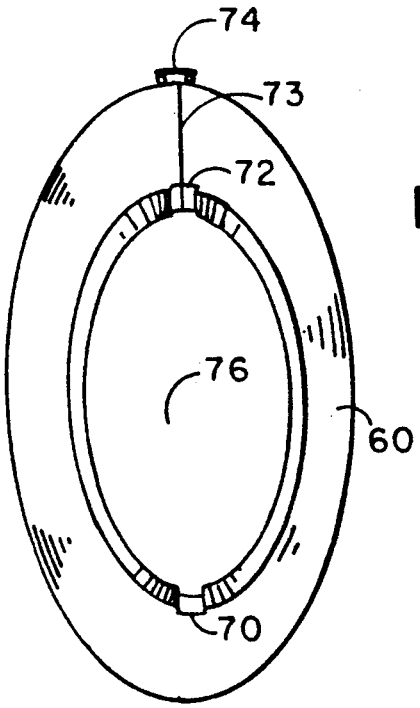
FIG. 5 illustrates a top view of the collar.
Figure 6:
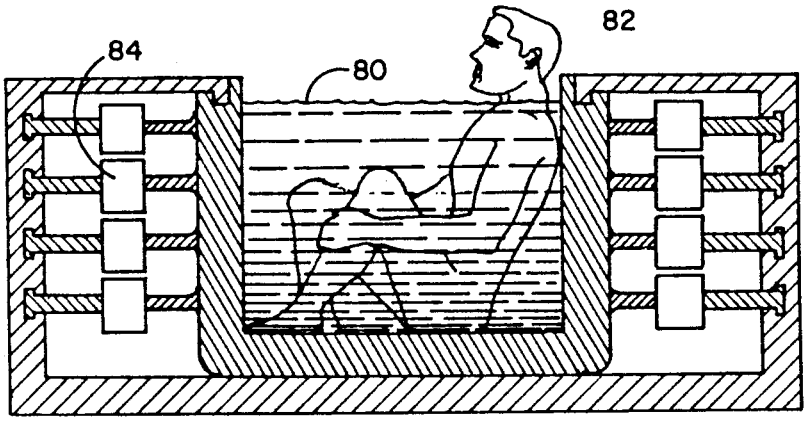
Figure 7:
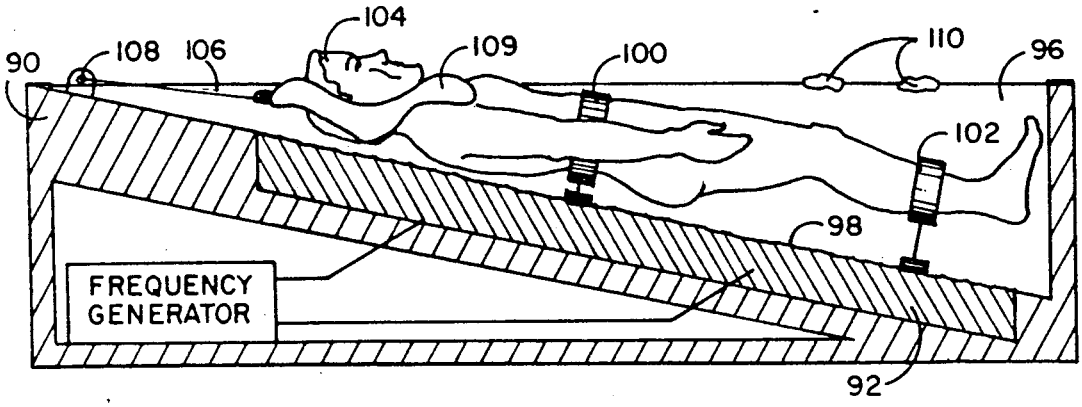
FIG. 7 illustrates an alternate containment chamber construction with vibrating means disposed therein.

The dimensions of the therapeutic bath can vary depending on the requirements and physical abilities of the user. While it is anticipated that able, conscious patients will enter the therapeutic bath of this invention directly and support themselves therein during the treatment, some patients, however, may have to sit or recline within the bath and in such case, the dimensions of the structure of the container would accommodate such user so that a patient could sit or recline with his or her head above the level of the surface of the medium such as seen in FIG. 6 which shows an alternate embodiment of the chamber which is lower in height that the device of FIG. 3 to allow an individual 82 to sit with his head above medium 80. This containment chamber operates in the same manner as the larger chamber of FIG. 3 with vibrating means 84 vibrating the medium through the containment chamber walls. It is anticipated that various size modifications of the containment chamber as well as various positionings of the electrical or pneumatic vibrators around the containment area can be accomplished within the scope of this invention. Patients that are unconscious or physically unable to enter the bath without assistance can be placed within the medium by harnesses 66 and lifts 68 as seen in FIG. 3 and in some cases, the containment chamber can conform closely to the oval axial shape of a patient's body. A foam collar 60 can be placed around the patient's neck to support his head above the water while the balance of the collar as seen in FIGS. 3 and 4 rests on structure 62 above the top of the surface of medium 64. This positioning would prevent the patient's head from slipping beneath the medium's surface. A closer view of this collar is seen in FIG. 4 where collar 60 is positioned around an individual's head 68 and allows room for harness 66 to also pass therethrough. FIG. 5 is a top view of collar 60 which can be constructed of a foam cushion material and have a cut 73 at one end with a latch 74 to hold it closed after it has been placed around the patient's neck which neck fits in area 76 but the chin and jaws of the patient extend over collar 60 itself. Notches 70 and 72 are provided for harnesses 66 to pass therethrough. Collar 60 must be composed of a sufficiently strong material to support and hold the patient's head out of the medium especially in cases where the patient is unconscious.

it is also expected that for some usages containment chamber 34 can be composed of a rigid material for use with acoustical or ultrasonic generators for higher frequency treatments. Such ultrasonic generators could be utilized in place of the vibratory type and may operate with a starting and stopping cycle so that the medium such as fluorine compounds in contact with the skin will soak through debris, loosening and removing it while supplying oxygen to the skin and thereby benefiting a burn patient. Such an embodiment is seen in FIG. 7 where an individual 104 is suspended in medium 96 and held in place by straps 100 and 102. A floating head collar 109 keeps the individual's head 104 above the medium level. Collar 109 can be retained by cable 106 to attachment point 108 on chamber 90. The individual being held in place by cable 106 and collar 109 will not slide down inclined ramp 98. The bottom of inclined ramp 98 contains an ultrasonic frequency generator 92 to impart vibrations to medium 96. Any loose debris 110 will float to the surface where it can be scooped out by hand or can otherwise be removed from the medium.

As discussed above the baths of this invention can be of various sizes. For example, smaller baths could be used to receive a patient's foot, leg or hand.

Figure 8:
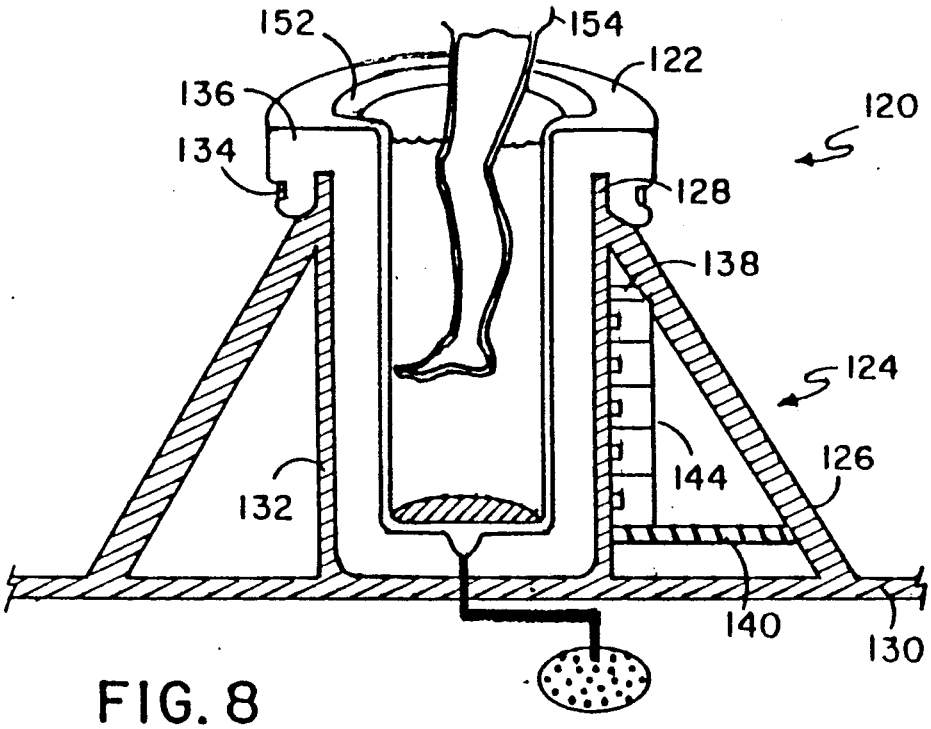
FIG. 8 illustrates a cross-sectional elevational view through an alternate containment chamber utilizing a bladder for containing the medium.
Figure 9:
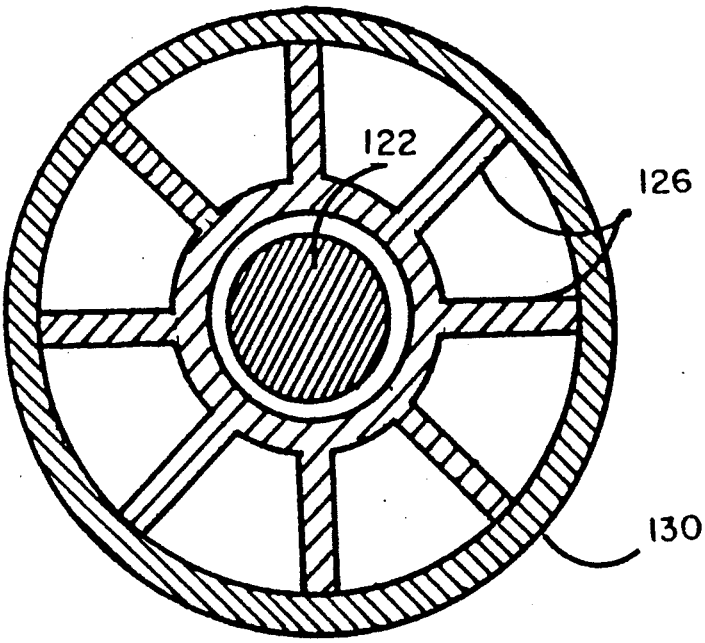
FIG. 9 illustrates a top plan view through the containment chamber of FIG. 8.

Full body baths have significant weight and must be adequately supported to prevent the flexible containment chamber from bulging at its bottom and to prevent damage to the floor. FIG. 8 illustrates a cross-sectional elevational view through such a bath where the containment chamber of bath 120 consists of bladder 122 suspended on frame 124 having braces 126 extending from rim 128 to base 130 which base is wider than bladder 122 to help spread the weight of bath 120 over a larger floor area. Many vertical rails and braces extend around the bladder. Frame 124 having vertical rails 132 helps support bath 120 to hold its sides in place and prevent bulging. Frame 124 can be made of fiberglass, wood, plastic, metal or any other equivalent material that will provide adequate support for the very heavy bath 120 including its contents. Since the floors found in some buildings may not be built to support extremely heavy weights over small areas, it is desirable to spread the weight of the bath to wider frame 124 and base 130 so that the weight is spread over a much larger floor area. Outer ring band 134 is used to hold top 136 of bladder 122 on frame 124. Bladder 122, as discussed above, must be flexible to allow for the transfer of the vibratory motion whether it be caused by mechanical, electronic, electromagnetic or pneumatic vibrators or any other equivalent means of imparting motion to various areas of bladder 122. Bladder 122 can be constructed of a variety of materials including silicon rubbers, neoprene rubbers, RTV silicon, natural rubbers or any other equivalent flexible material. Bladder 122 must, however, be thin enough to transfer the energy of the motion being generated from the exterior of the bladder walls through the bladder itself into the medium. Ring band 134 can be constructed of metal with tightening means such as clamp closures used to maintain hoses in position such as in automobiles or equivalent. Ring band 134 maintains and holds top 136 of bladder 122 from collapsing into the center of frame 124 since in this version bladder 122 is essentially suspended from rim 128 of frame 124. The framework can be constructed of a plurality of parts which can be disassembled for easy transport, especially through doorways and the like and then reassembled for usage. The framework can have, as seen in the top view of FIG. 9, a plurality of brace members 126 extending around bladder 122 supporting rim 128. Braces 126 extend downward to wide base 130 to disperse the weight of the structure over a wide floor area. Around the structure can be arrayed the vibration means which can be attached to the bladder wall between braces 126. Frame 124 can be used to support the vibration means such as servos, motorized cams, pneumatic or hydraulic cylinders, electromagnetic apparatuses or equivalent. Braces 126 or other frame members can have thereon support members 138 and 140 extending laterally to support arrays 142 of vibratory devices 144 to be positioned adjacent to bladder 122. Support members 138 and 140 can hold vertical racks 146 of vibratory devices 144 which racks 146 can be positioned on support members such as support member 140 which can be located between each brace and held in place by bolts or other equivalent retention means. A series of vertical rails 132 can extend around the sides of bladder 122 to prevent bulging from occurring at the bottom of the bladder due to the great weight of its contents.

Figure 10:
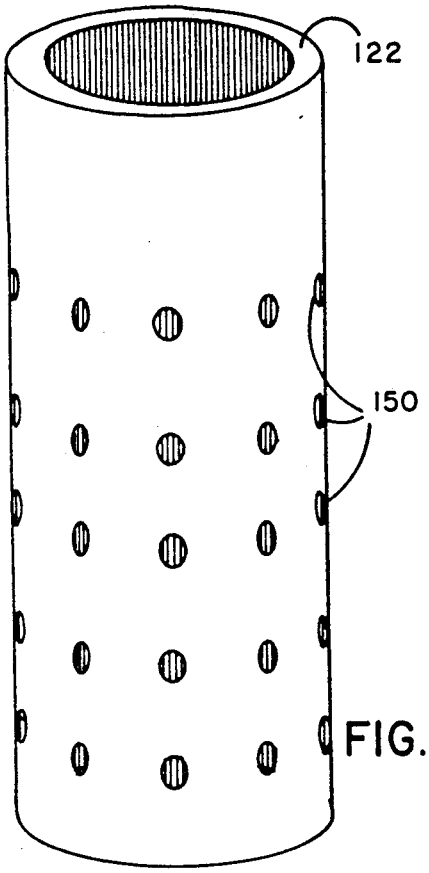
FIG. 10 illustrates a perspective view of a bladder having magnets affixed to its external surface.

In some embodiments as seen in FIG. 10 magnetic members 150 can be mounted to bladder 122 itself and can be activated by electromagnets positioned in the vertical racks and which cause magnets 150 to move back and forth. Although such magnetic structures are quite expensive to produce due to the number and cost of the magnets needed, they work quite well. Such electromagnets can be controlled sequentially for the various effects desired and can achieve any desired vibration pattern for the user.

Figure 12:
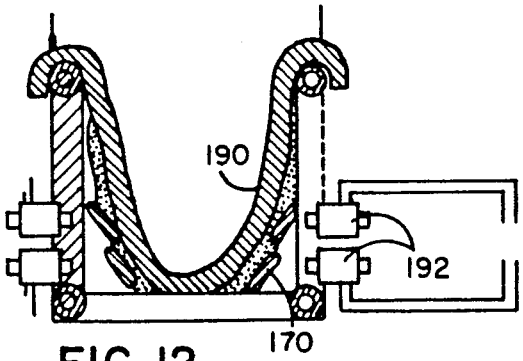
FIG. 12 illustrates a cross-sectional elevational view of a bladder wall having magnetically attractive elements within its wall structure.
Figure 13:
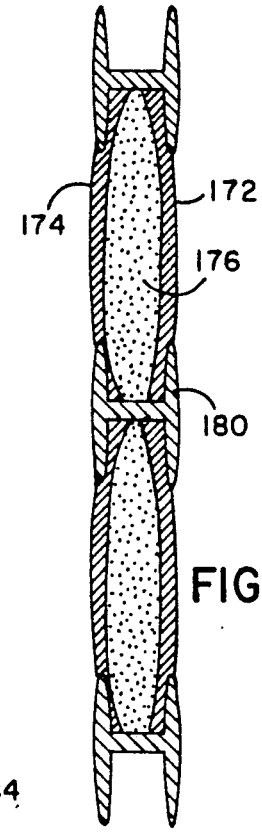
FIG. 13 illustrates a cross-sectional end view through the magnetically attractive elements of the wall of FIG. 12.
Figure 14:
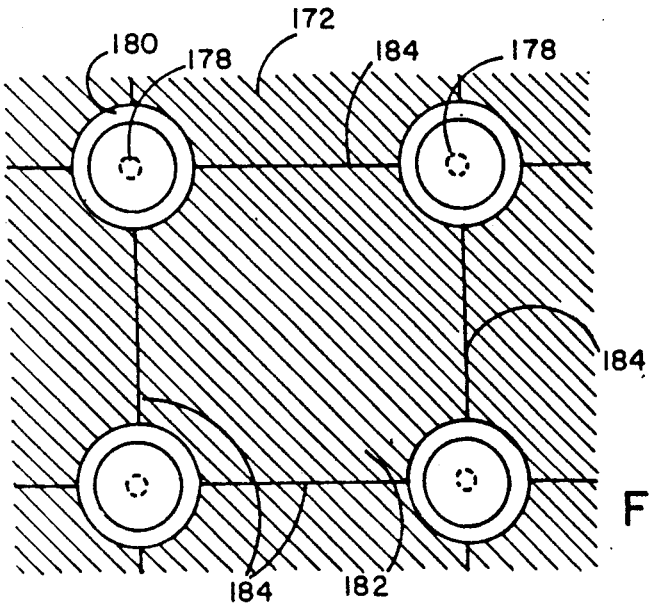
FIG. 14 illustrates a side view of a section of the magnetically attractive element wall of FIG. 12.

In another embodiment where electomagnetic force is used, bladder member 170, as seen in FIG. 12 and in cross-section in FIG. 13, can consist of a rubber like material 172 and 174 sandwiching powdered iron 176 or other magnetically attractive material therebetween in pockets with a plurality of apertures 178 seen in front view of FIG. 14 formed with rivets 180 therethrough maintaining powdered material 176 between separated sealed pockets 182 formed along closure lines 184 formed by heat sealing or stitching so that the magnetically attractive powdered material is held in such pockets throughout the sides of the exterior of bladder 170. This structure can be lined with liner 190 as seen in FIG. 12 or a second bladder and the structure is acted upon by electromagnets 192 arrayed around the exterior of the bladder to produce a structure that can be vibrated effectively.

In some embodiments the bladder can have a disposable liner 152 as seen in FIG. 8 to make the device easy to clean and more sanitary between uses. Liner 152 can be made of any suitable waterproof material such as polypropelene or polyethylene and placed in the bladder prior to filling the liner with the medium. The liner after treatment can be drained and then discarded. The liner helps keep the bladder itself free from contact with the various mediums that may be placed in the container enabling the bladder to last longer since it will not be affected by hydrolysis where the fluid medium might be absorbed into the inside bladder wall. In some cases, especially where electromagnets are used, the liner can be used as part of the source of vibrations by being made of metallic foil-faced Mylar material which is attracted by the electromagnets. The foil-faced Mylar can be electrically grounded to reduce or eliminate any effects of exposure to intense electromagnetic fields.

in some instances patients can be placed in a second liner 154 as seen in FIG. 8 prior to immersion into the bath which procedure is desirable in some cases. The patient in such an instance need not even disrobe for therapy because the limb is kept dry by second liner 154 over the limb or body member and merely the effect of the vibrating fluid medium is felt against the body. Second liner 154 in which the patient's body or limb is placed would be draped over the top of bladder 122 and, if desired, fastened down by means of a clamp such as ring band 134.

Figure 11:
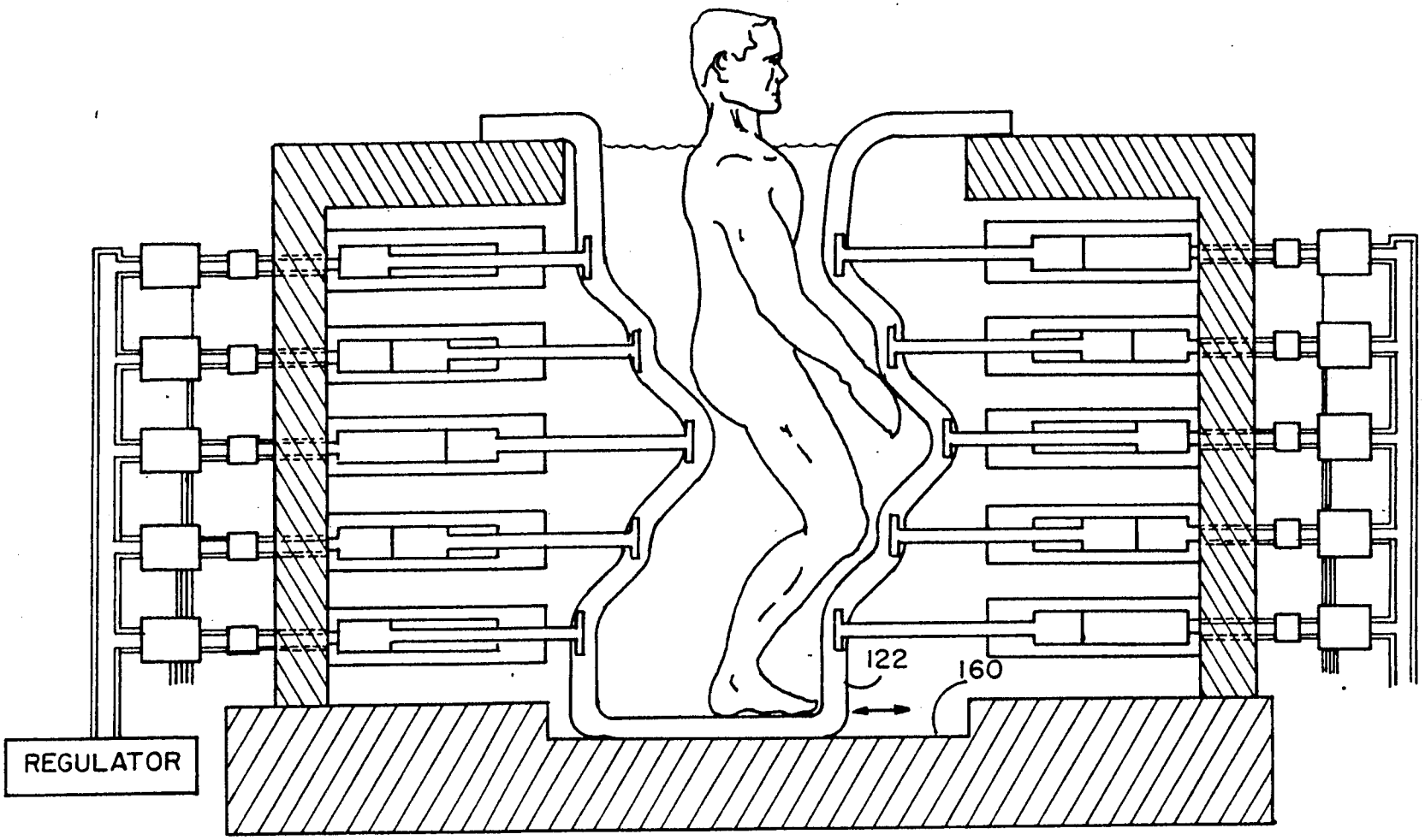
FIG. 11 illustrates a bladder of the type that is movable at its base by the vibrators.

FIG. 11 illustrates a pneumatic piston vibration system that is adapted not only to move the water but also to move the patient therein for passive exercise of muscles over a wide range of body movements. Bladder 122 is free to move at its bottom in area 160 in all lateral directions while the top of bladder 122 is supported.

It has been noted in some uses of the bath of this invention that the vibrations can cause numbness throughout a limb within the bath. Since such numbness is achieved without the use of medication, such bath can be used as part of therapy.

Figure 16:
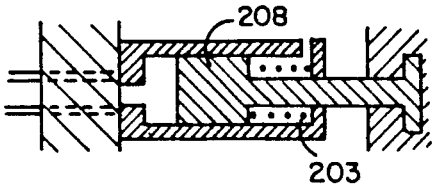
FIG. 16 illustrates an enlarged view of one of the pistons of FIG. 15.
Figure 15:
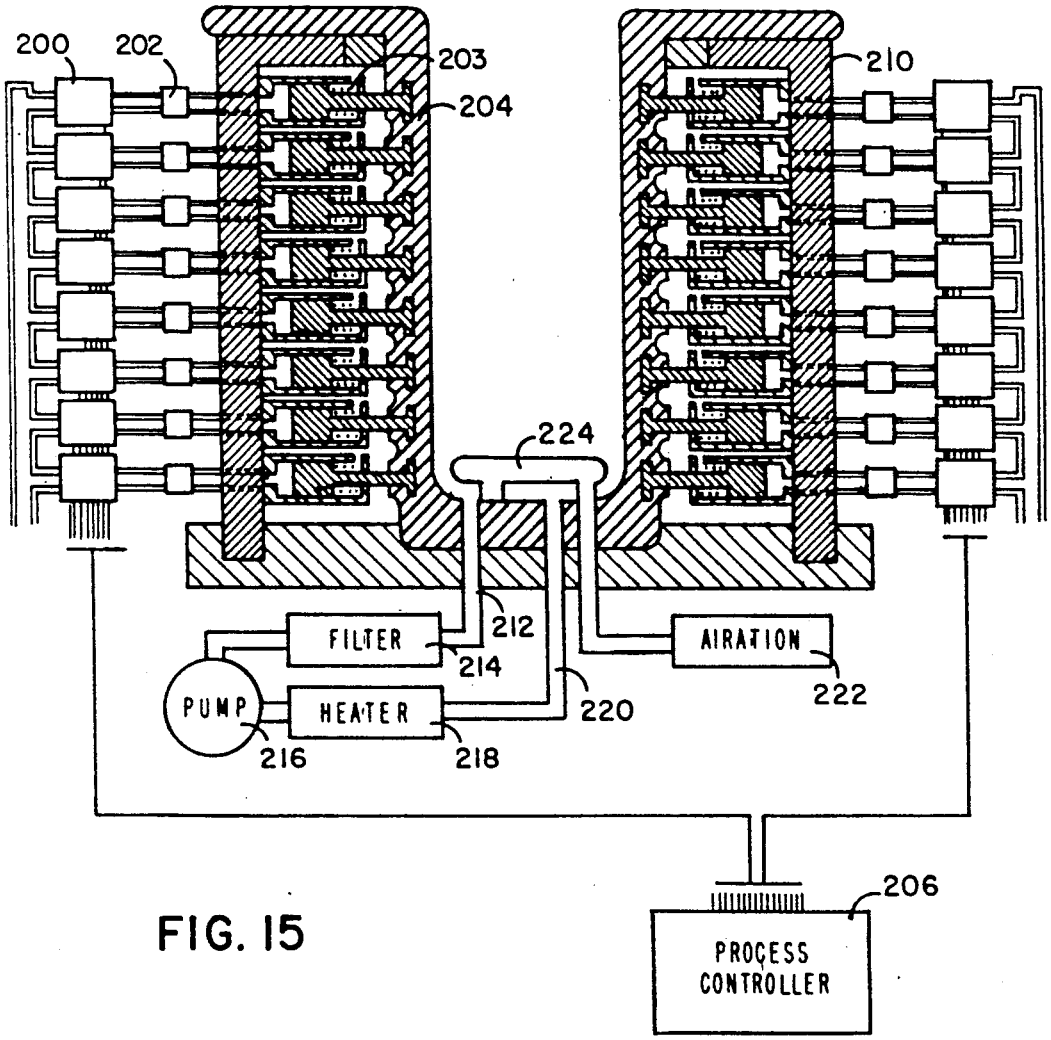
FIG. 15 illustrates a cross-sectional elevational view of an alternate embodiment of a containment chamber of this invention with electropneumatic piston drive.

FIG. 15 illustrates a cross-sectional view of an alternative bath structure utilizing flexible bladder wall 204 with a plurality of pistons imbedded in its side wall, such bladder being attached to and supported on frame 210. Electro-pneumatic valves 200 allow air to enter as controlled by sequence process controller 206 through a one-way quick release valve 202. As long as the electro-pneumatic valve is open, air passes into cylinder compressing spring 203 and moves cylinder 208 forward as seen in FIG. 16 which moves bladder wall 204. When air pressure is ceased by electropneumatic valve 200 not being biased on, the one-way quick air release valve 202 allows piston 208 to be driven rearward in the cylinder by spring 203 so as to return bladder 204 to its original position. At the bottom of bladder 204 is seen drain 212 which runs the medium through filter 214 by action of pump 216. The fluid can be heated by line heater 218 and returned to the bath through pipe 220. if aeration is desired, it can be provided through member 224 from aeration pump 222.

Figure 17:
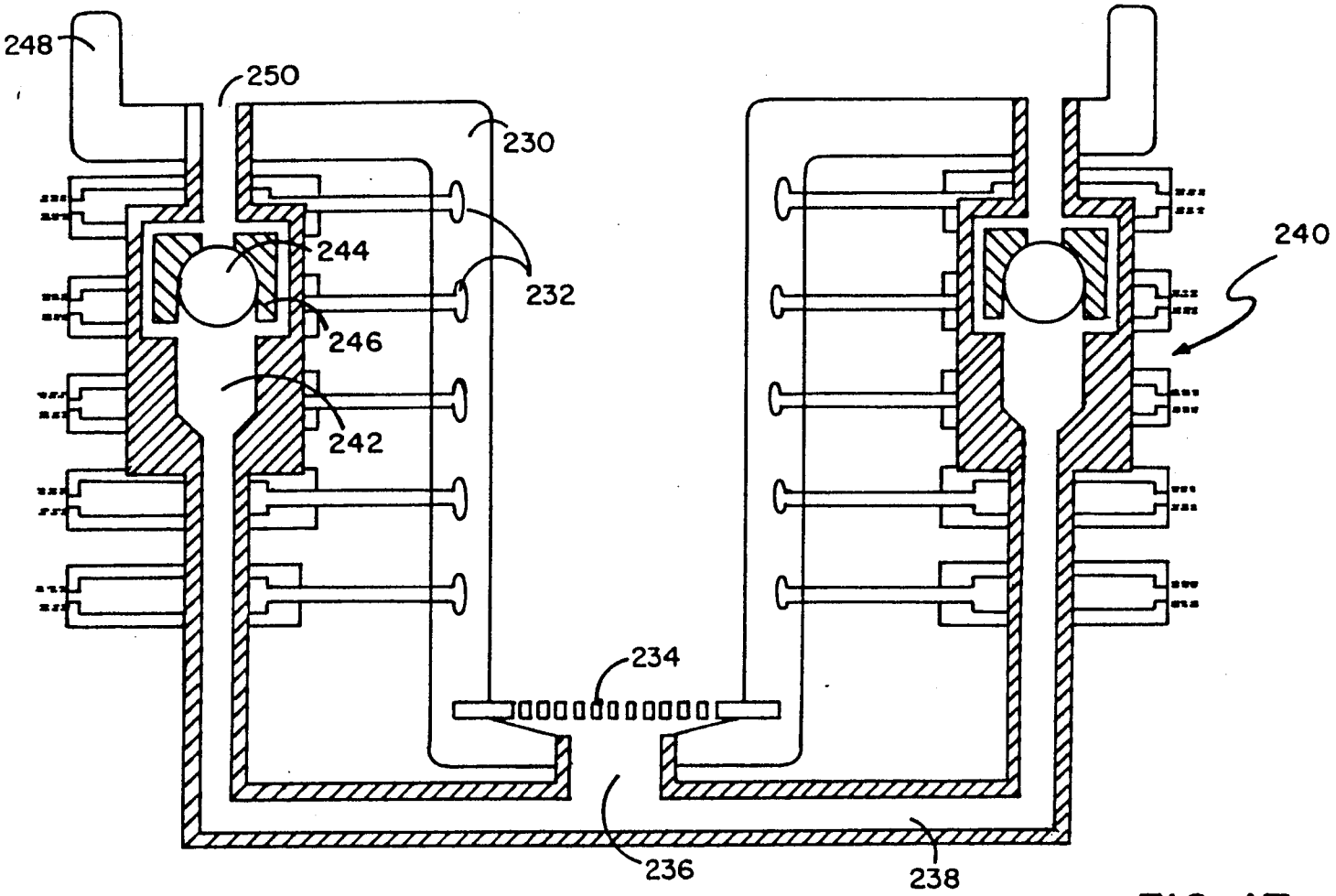
FIG. 17 illustrates a cross-sectional view through an alternate embodiment of the bath especially adapted for achieving negative pressure.
Figure 18:
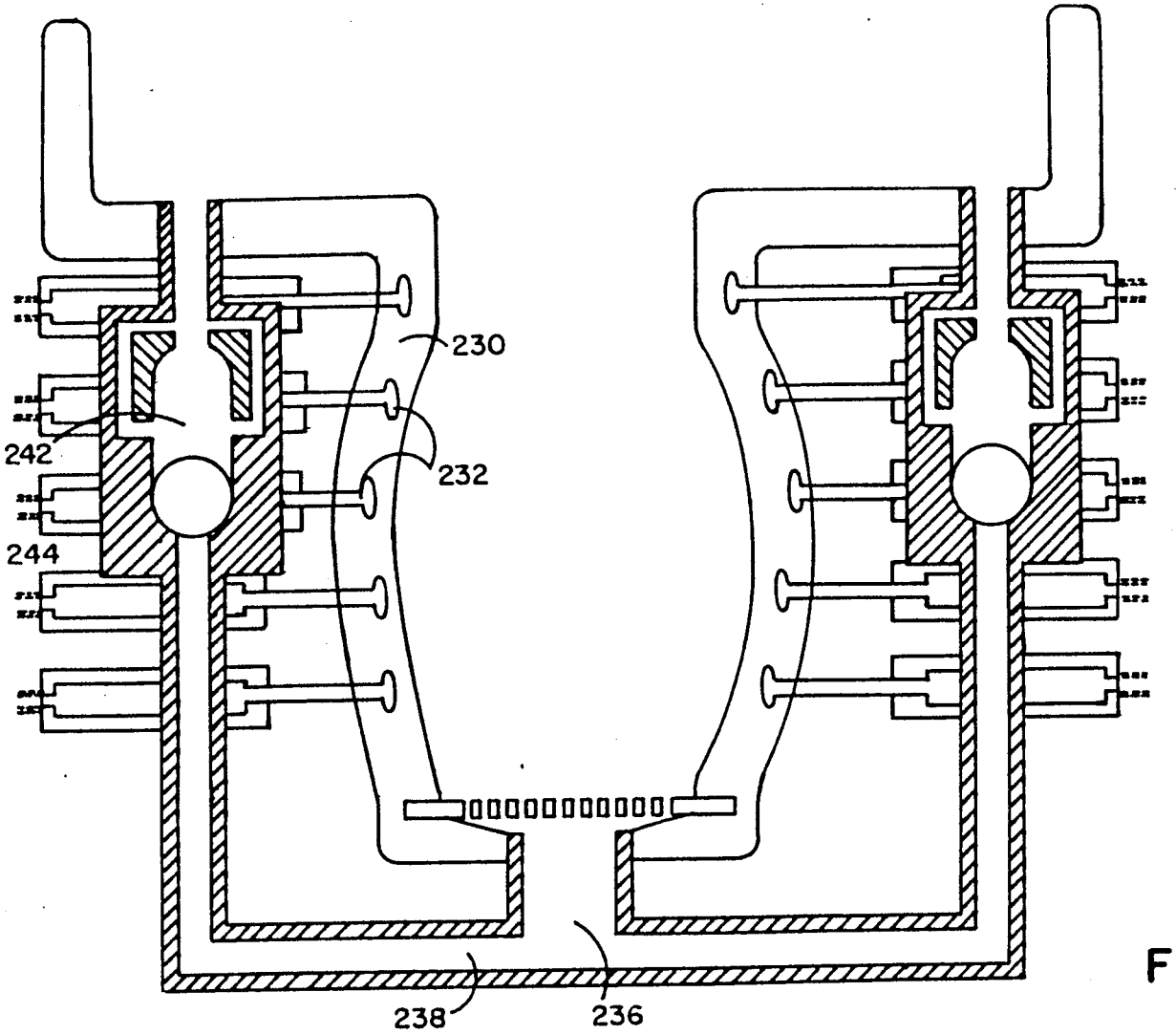
FIG. 18 illustrates the bath of FIG. 16 with the side walls in a different position.
Figure 19:
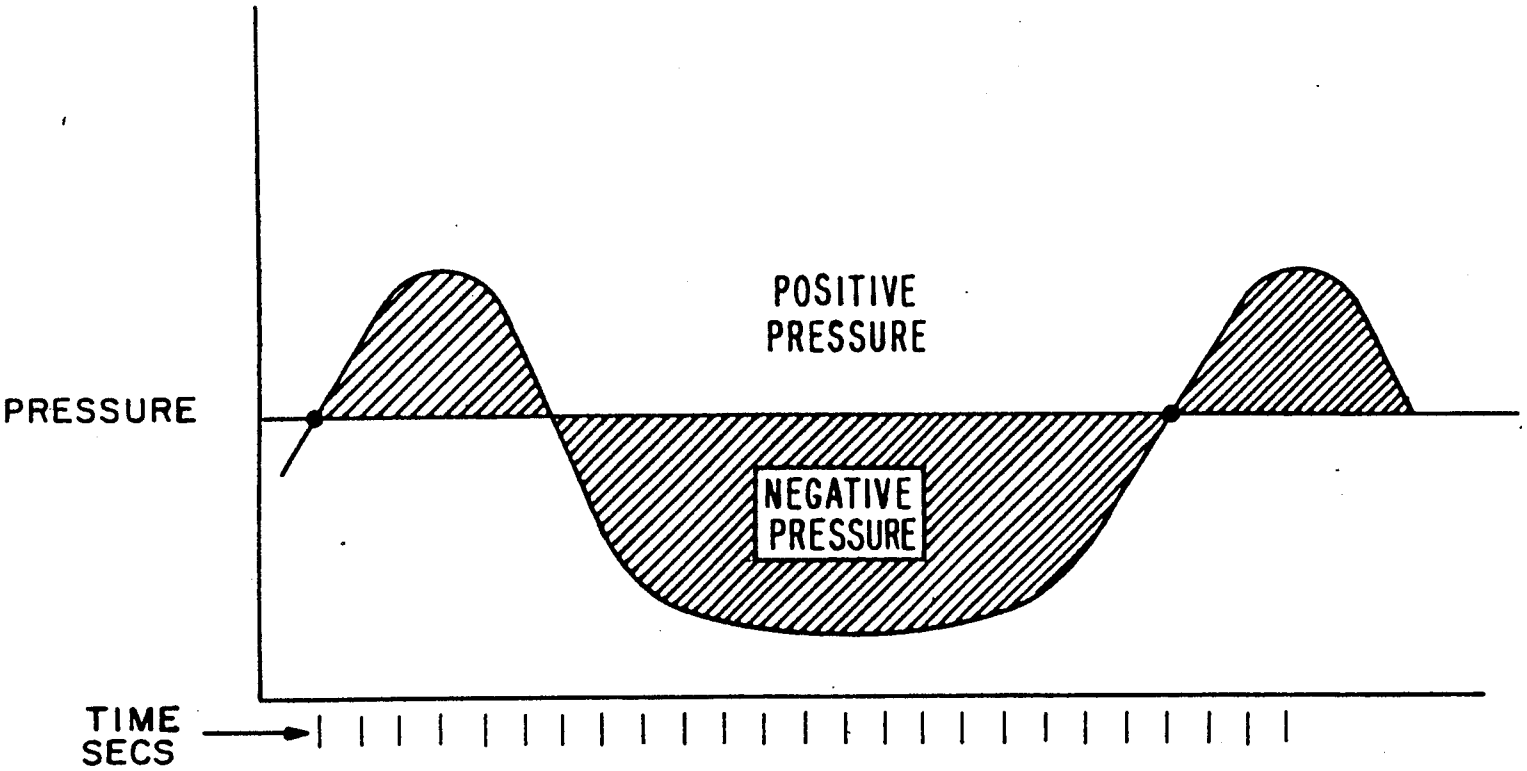
FIG. 19 illustrates a graph of the positive and negative pressure periods of the bath of FIG. 17.

FIG. 17 illustrates a bath in which negative pressures can be achieved around the body which negative pressures are desirable in certain situations such as where an individual may have poor circulation and the negative pressure will assist in blood flow to the body surface and extremities. Seen in this view are pistons 232 mounted in bladder wall 230. Drain 234 at the bottom of the bath allows fluid to pass through connector pipe 236 through pipe members 238 to ball check valves 240. The ball check valves have their second ports 250 within lips 248 which contain the medium in a second chamber above the upper surface of the vibration chamber and above second ports 250. In practice, as seen in FIG. 18, when the lower pistons pull outward, the bottom of the stretchable bladder increases the volume of the chamber and fluid rushes in from the second chamber between lips 248 into the larger volume of the vibratory bath, causing the reduced pressure around the user. In this embodiment fluid is also drawn through pipe 236 from the ball check chambers which forces ball 244 to seat at the bottom of ball check chamber 242 stopping such fluid flow. When the cylinders start moving inward, fluid is forced out of the top and bottom of the containment chamber by the bladder walls as they encompass a smaller volume. This fluid then not only passes upwards to the area of the second chamber between lips 248, but also moves ball 244 to the upper portion of the ball check chamber 242 allowing fluid to pass through channels 246 and out through port 250 to help equalize the pressure quickly between the top and bottom of the bath. FIG. 19 graphs the pressure starting at point 251 where the pistons are in their outermost positions and are pushing inwards increasing pressure until they are in the innermost positions as seen in FIG. 17 where they then start moving outward again creating a negative pressure within the bath. The total negative pressure on the body over time is greater than the positive pressure to achieve the therapeutic advantage of this embodiment. The pressure level in the bath can be self-regulated by the patient. A loose-fitting seal made of a closed-cell, rubber like foam or equivalent can be provided in the form of a collar placed around the patient, allowing the patient by maneuvering the collar, to block the top of the bath which as the chamber volume is expanding creating a negative pressure, will increase the effect of the negative pressure by not allowing medium to enter from the top of the bath. if the patient desired, he could move the collar to allow medium to enter the bath which action would reduce the increase in negative pressure. if the patient on his own did not move the seal, the seal itself would deform as it is sucked downward into the bath as the negative pressure increases and would no longer make a seal. The breaking of the seal would allow medium into the bath from the top.

Although the present invention has been described with reference to particular embodiments, it will be apparent to those skilled in the art that variations and modifications can be substituted therefor without departing from the principles and spirit of the invention.

I claim:

1. In an apparatus for providing a selectable therapeutic treatment to an individual in need of such treatment and wherein the individual is positioned within a fluid medium contained within a fluid containment vessel having walls defining a fluid containment chamber, the improvement comprising:

a plurality of vibratory devices disposed exteriorly about the periphery of the fluid containment vessel and attached to the walls of said vessel, each vibratory device being capable of vibrating the vessel to produce vibratory motion within the fluid medium contained within the fluid containment chamber sufficient to move said medium for passive movement of said patient;

means for attaching the vibratory devices to the walls of the vessel;

a casing within which the containment vessel and the vibratory devices are disposed;

an arm means carried by each vibratory device for attaching each vibratory device to a location of the wall of the containment vessel;

means carried by each vibratory device for attaching each vibratory device to a location of the casing, the vibratory devices being substantially held in tension between the casing and the containment vessel, the vibratory motion producable by each vibratory device being efficiently transmittable through the arm means attached thereto to the containment vessel and then to the fluid medium within the containment chamber;

means for selectably controlling the operation of the vibratory devices in order to operate the devices in desired vibration wave patterns, the vibration wave patterns being selectable from a variety of possible wave patterns to cause a specific therapeutic result; and wherein the containment vessel is formed of a resilient material and is cylindrical in conformation.

2. The apparatus of claim 1 wherein the devices form a series of substantially planar arrays extending parallel to each other along the length of the vessel.

3. The apparatus of claim 2 wherein the controlling means may operate each vibratory device at a selected frequency.

4. The apparatus of claim 3 wherein the controlling means comprises:

sequencer pattern memory means for storing a selection of patterns for operation of the vibratory devices; and, sequencer switching control means operably connected to the sequencer pattern memory means and to the vibratory devices for controlling power applied to each vibratory device.

5. The apparatus of claim 4 and further comprising means formed in the containment vessel for draining the fluid medium from said vessel.

6. The apparatus of claim 4 and further comprising means for supporting an individual within the containment chamber.

7. The apparatus of claim 4 wherein the vibratory devices are electrically driven mechanical vibrators or pneumatically driven vibrators.

8. The apparatus of claim 4 and further comprising means for recirculating the fluid medium.

* * * * *